US005595295A

United States Patent [19]

Lin

[11] Patent Number: 5,595,295

[45] Date of Patent: Jan. 21, 1997

[54] DEVICE FOR KEEPING AND DISPLAYING A SHEARING TOOL

[76] Inventor: C. S. Lin, No. 10, Lane 188, Gung-Ye Rd., Long-Ching Hsiang, Taichung Hsien, Taiwan

[21] Appl. No.: 529,463

[22] Filed: Sep. 18, 1995

[51] Int. Cl.[6] ..... A45C 11/26

[52] U.S. Cl. ..... 206/349; 206/461; 206/470

[58] Field of Search ..... 206/349, 461, 206/470, 471, 472, 493

[56] References Cited

U.S. PATENT DOCUMENTS

| | | | |
|---|---|---|---|
| 4,165,805 | 8/1979 | Fethke et al. | 206/349 |
| 4,341,307 | 7/1982 | Shyers | 206/472 |
| 4,423,811 | 1/1984 | Knapp | 206/470 |
| 4,872,551 | 10/1989 | Theros | 206/349 |
| 4,899,877 | 2/1990 | Kiernan | 206/349 |
| 5,279,417 | 1/1994 | Seaton | 206/349 |
| 5,435,447 | 7/1995 | Weatherford et al. | 206/461 |

*Primary Examiner*—David T. Fidei

*Attorney, Agent, or Firm*—Beveridge, DeGrandi, Weilacher & Young LLP

[57] ABSTRACT

A foldable device for keeping and displaying a shearing tool comprises a transparent top piece, a transparent bottom piece, and a connection piece located between the top piece and the bottom piece. The top piece is provided with a recessed receiving slot having a predetermined shape for holding the blades and the pivoting portion of the shearing tool such that the shearing tool can be tested without being removed from the device.

4 Claims, 5 Drawing Sheets

DEVICE FOR KEEPING AND DISPLAYING A SHEARING TOOL

FIELD OF THE INVENTION

The present invention relates generally to a device for keeping and displaying a hand tool, and more particularly to a device for keeping and displaying a shearing tool.

BACKGROUND OF THE INVENTION

As shown in FIG. 1, a prior art device for keeping and displaying a shearing tool is composed of a cover 1 which is made of a transparent material and is provided integrally with three folded edges 2 for holding a bottom plate 4. The device is further composed of a receiving slot 3 which is located between the cover 1 and the bottom plate 4 and is dimensioned to hold therein a shearing tool.

Another prior art device for keeping and displaying a shearing tool is composed of a connection piece 5 by which two plates 6 are held. One of two plates 6 is provided with a receiving slot 8 in which a shearing tool is kept. The receiving slot 8 is provided with a retaining slot 9 for preventing the shearing tool from slipping out of the device. The plates 6 are further held securely by a plurality of retaining apparatus 7 which are attached to the plates 6.

Such prior art devices as described above are generally defective in design in that the shearing tools kept in the devices can not be tested and inspected thoroughly by the consumers.

SUMMARY OF THE INVENTION

It is therefore the primary objective of the present invention to provide a novel device for keeping and displaying a shearing tool in such a manner that the shearing tool can be tested and inspected thoroughly by a consumer.

The foregoing objective of the present invention is attained by a foldable device for keeping and displaying a shearing tool, which comprises mainly a transparent top piece, a transparent bottom piece, and a connection piece located between the top piece and the bottom piece. The top piece is provided with a recessed receiving slot having a predetermined shape for holding the blades of the shearing tool such that the shearing tool can be tested without being removed from the device.

The foregoing objective, features and advantages of the present invention will be more readily understood upon a thoughtful deliberation of the following detailed description of the present invention in conjunction with the accompanying drawings.

DETAILED DESCRIPTION OF THE INVENTION

Figure 1:
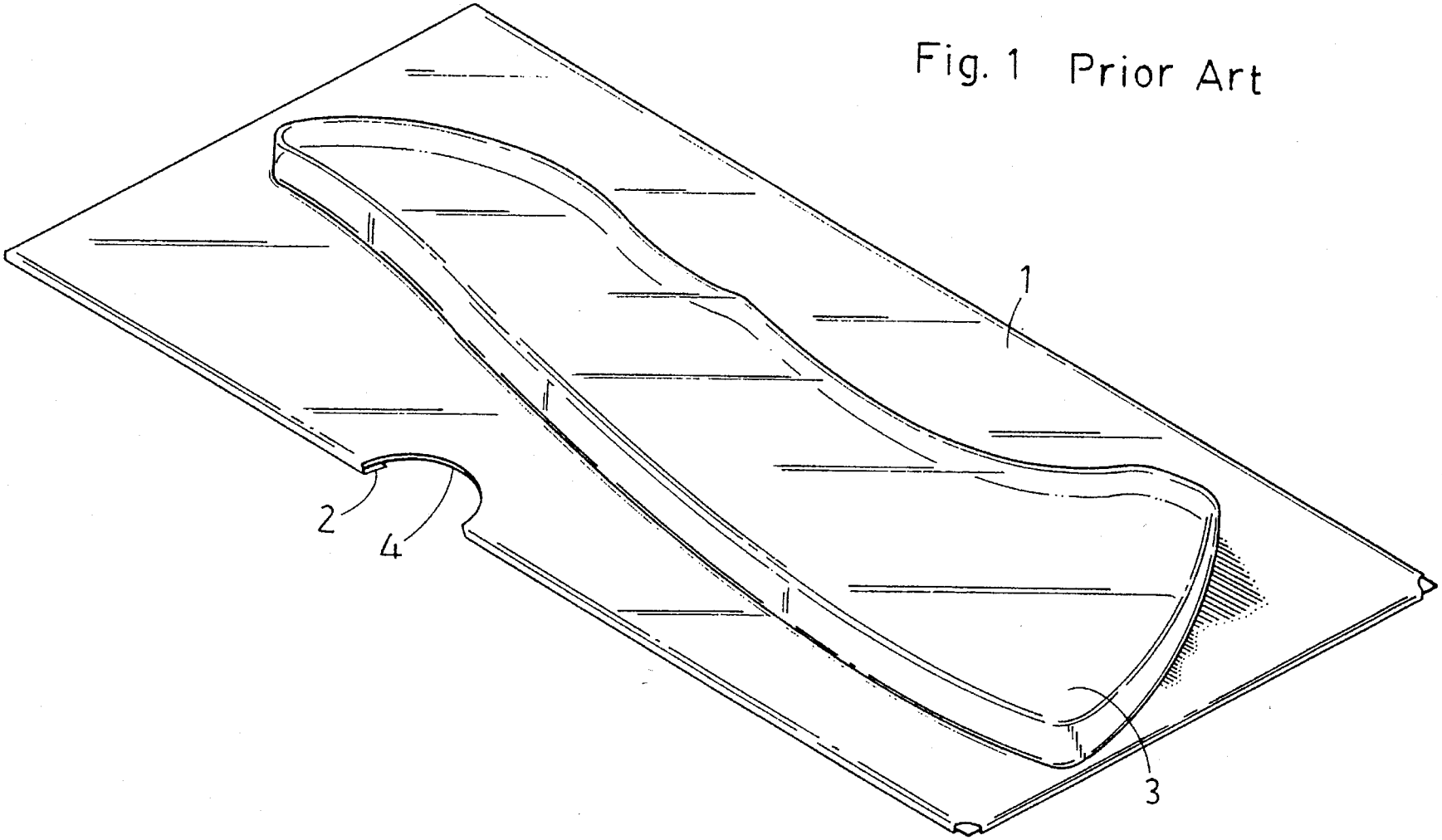
Fig. 1 Prior Art
FIG. 1 shows a perspective view of a prior art device for keeping and displaying a shearing tool.
Figure 2:
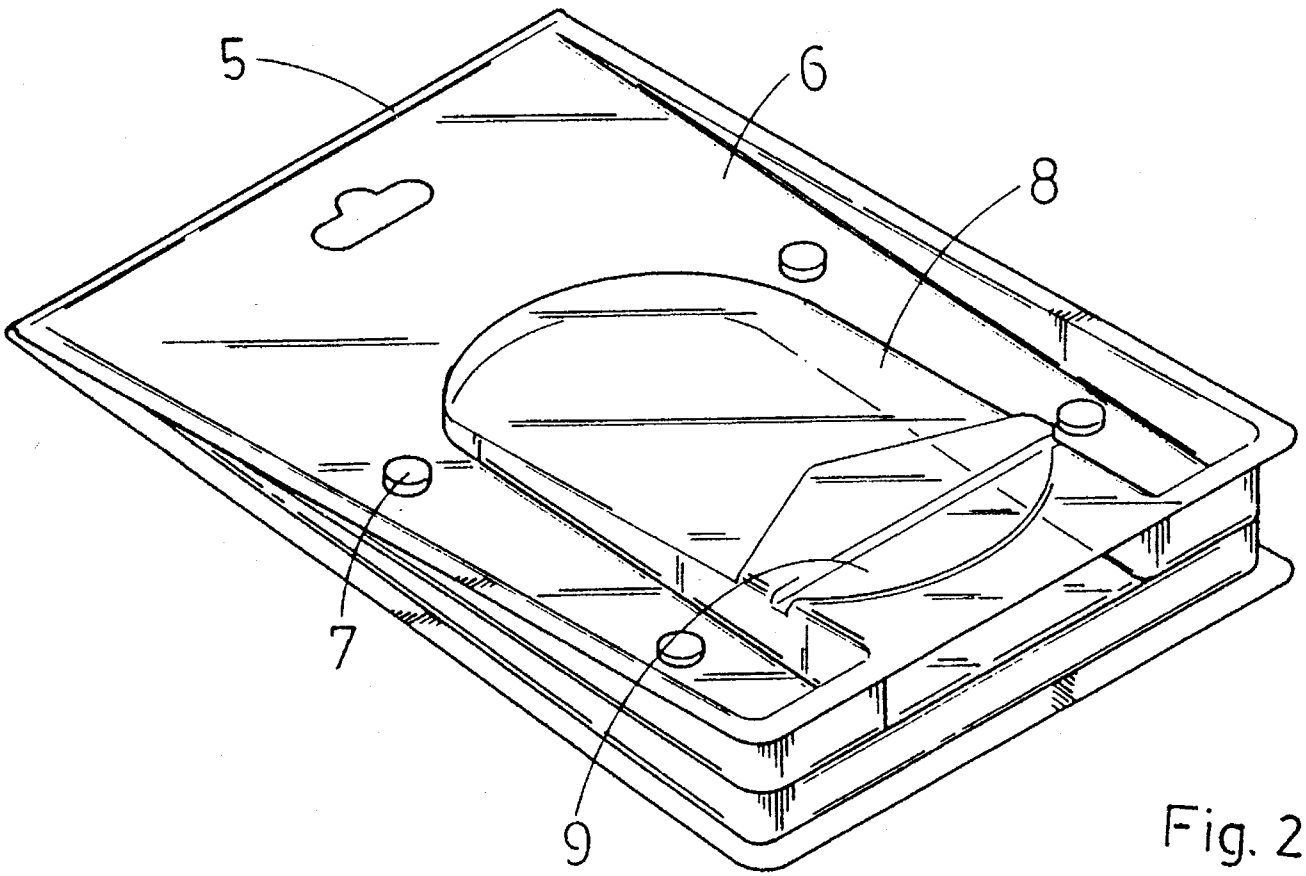
Fig. 2 Prior Art
FIG. 2 shows a perspective view of another prior art device for keeping and displaying a shearing tool.
Figure 3:
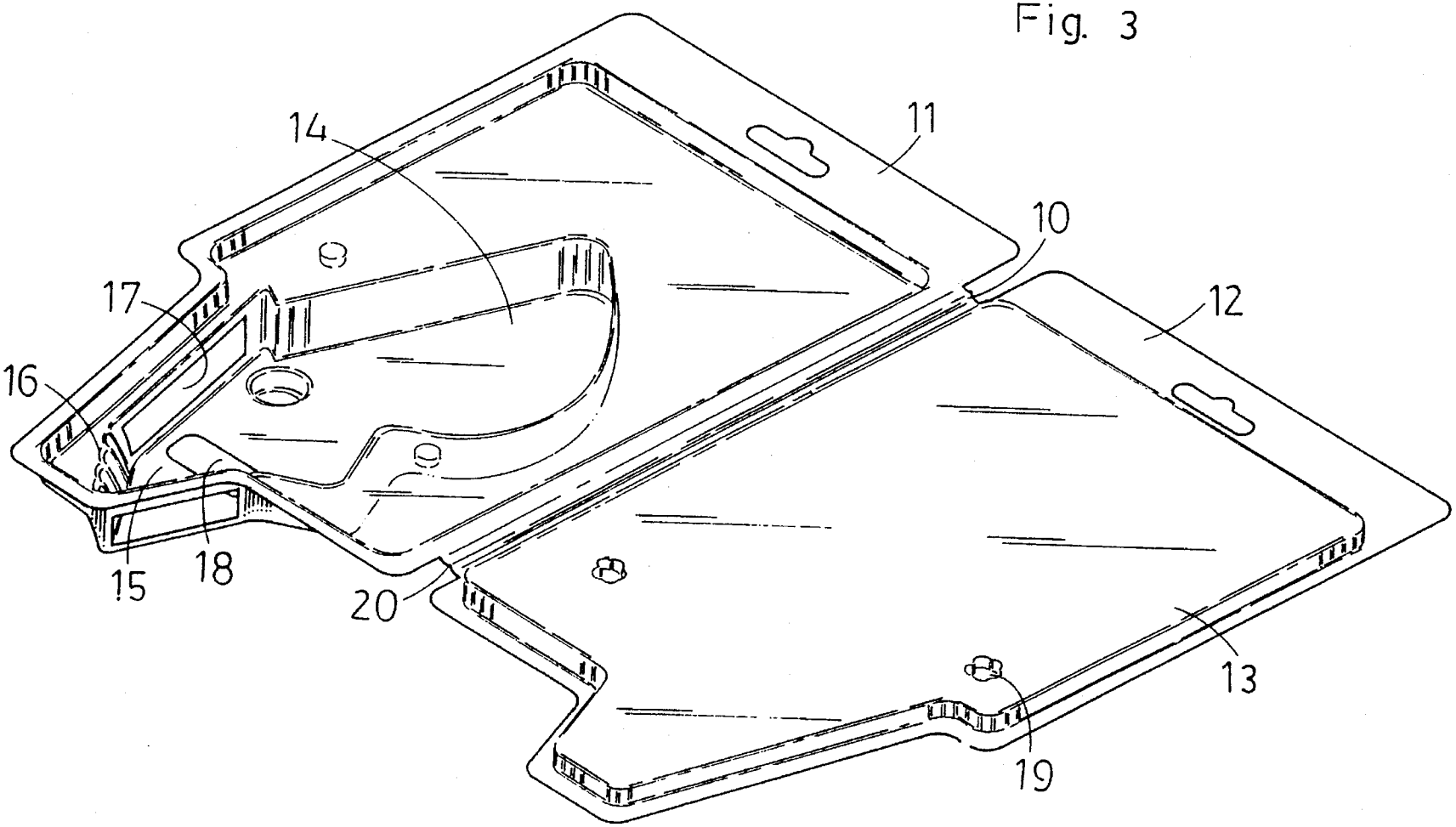
FIG. 3 shows a perspective view of an unfolded device of the present invention for keeping and displaying a shearing tool.

As shown in FIG. 3, a device embodied in the present invention comprises a transparent top piece 11, a transparent bottom piece 12, and a connection piece 10 located between the top piece 11 and the bottom piece 12. The connection piece 10 has a folding edge 20 of a memory type to facilitate the folding and the unfolding of the device of the present invention.

The bottom piece 12 is provided with a recessed holding slot 13 while the top piece 11 is provided with a recessed receiving slot 14 having a predetermined shape for holding the blades and the pivoting portion of a shearing tool. Located at the entrance end of the receiving slot 14 is a holding portion 15 comprising a plurality of reinforcing ribs 16, two through holes 17, and a holding hole 18. The top piece 11 and the bottom piece 12 can be held together by a plural try of retaining bodies 19.

Figure 4:
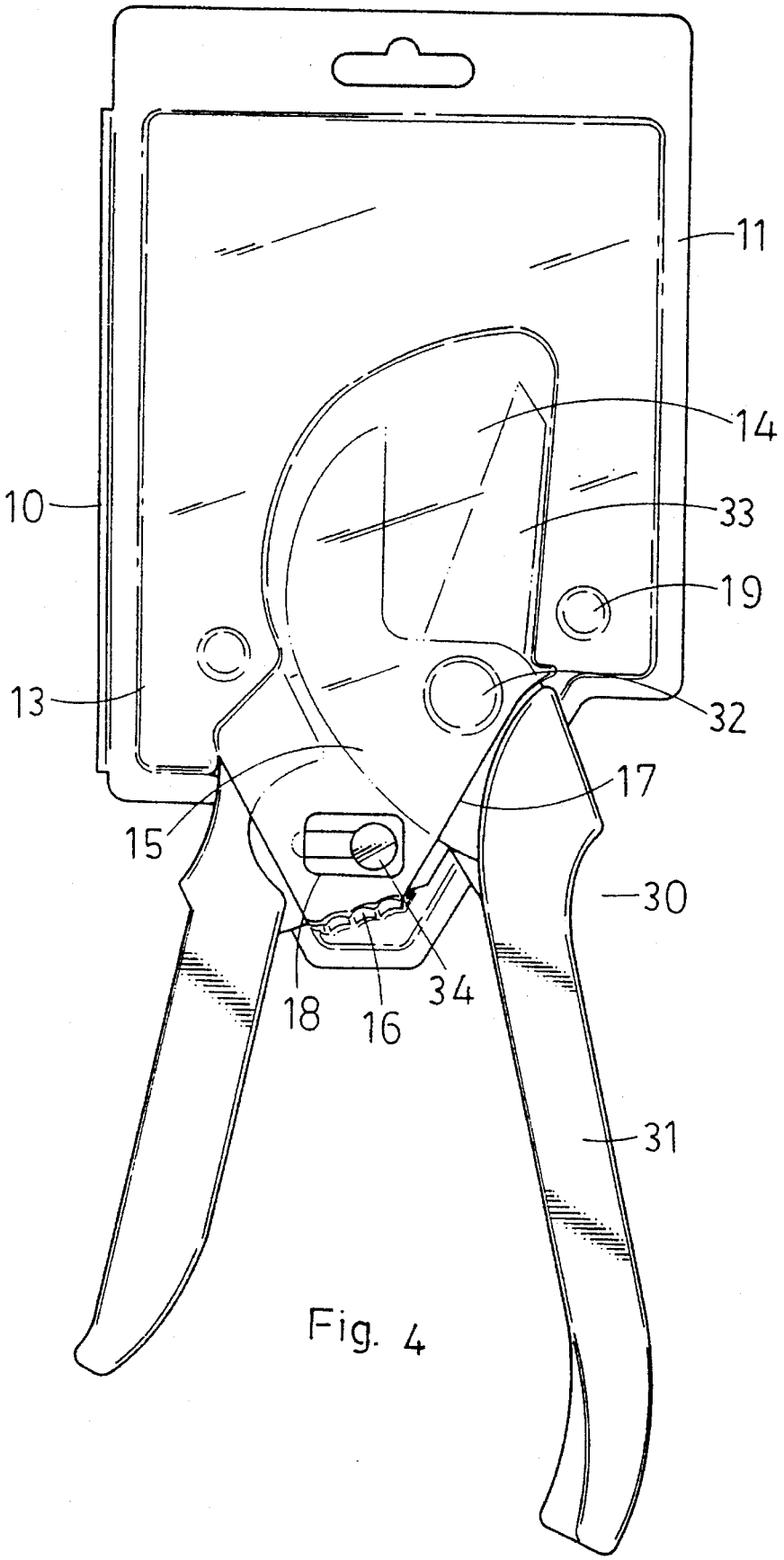
FIG. 4 shows a perspective view of the present invention at work.

As shown in FIG. 4, a shearing tool 30 is kept in the device of the present invention such that two hand grips 31 of the shearing tool 30 are put through two through holes 17, and that the pivoting portion 32 of the shearing tool 30 is held by the reinforcing ribs 16, and further that the blades 33 of the shearing tool 30 are received in the receiving slot 14, and still further that the switching element 34 of the shearing tool 30 is located in the holding hole 18.

Figure 5:
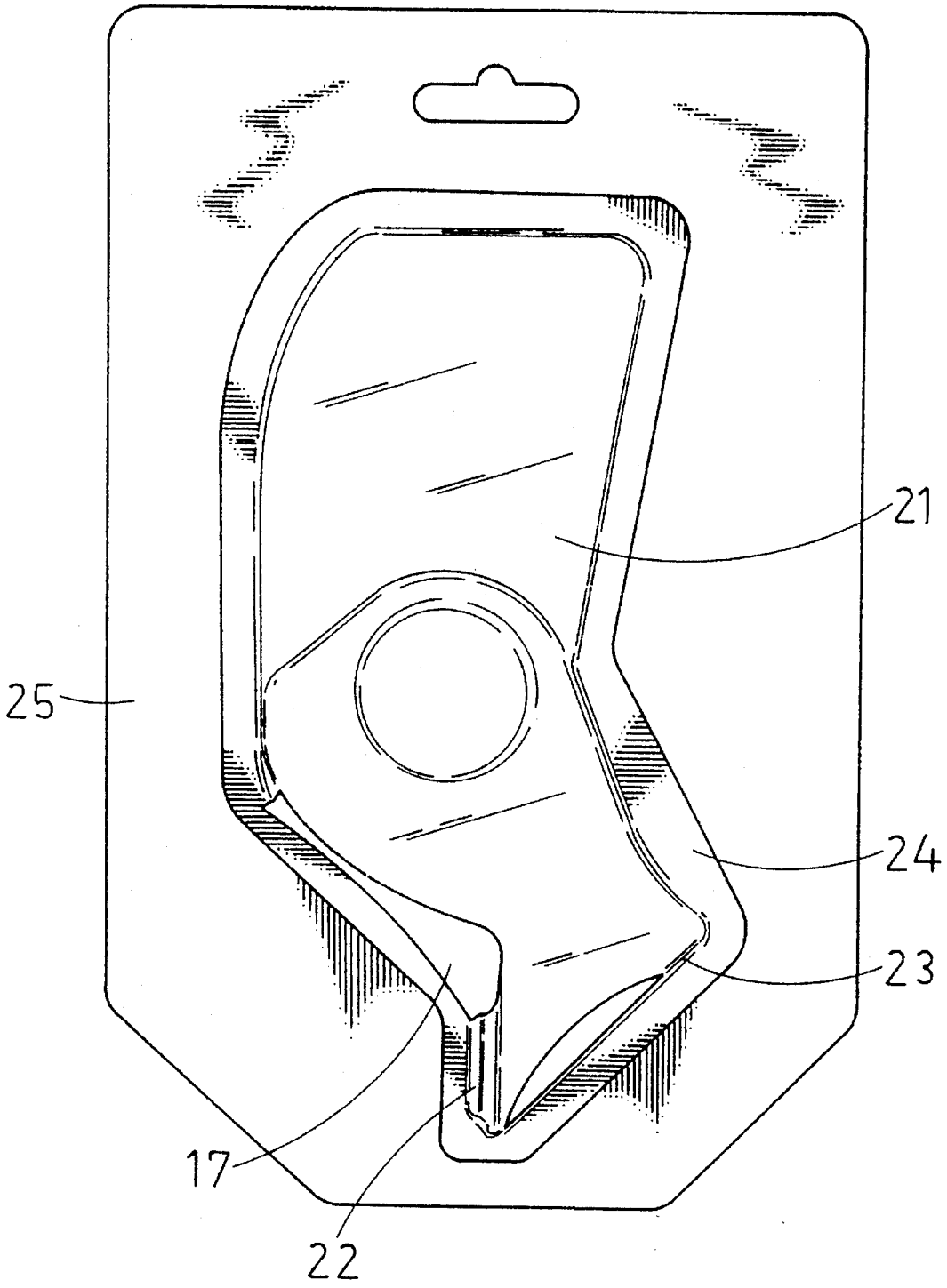
FIG. 5 shows a perspective view of another preferred embodiment of the present invention.

As shown in FIG. 5, another preferred embodiment of the present invention comprises a transparent platelike body which is provided integrally with a receiving slot 21, a plurality of reinforcing ribs 22, two through holes 17, and a holding piece 23. The receiving slot 21 is defined by an adhering edge 24 engageable with a bottom plate 25.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A device for keeping and displaying a shearing tool comprising:

a transparent top piece provided with a recessed receiving slot for receiving blades and a pivoting portion of a shearing tool, said receiving slot provided at an entrance end thereof with a holding portion comprising a plurality of reinforcing ribs for holding said pivoting portion of said shearing tool, two through holes for receiving therein two hand grips of said shearing tool said holding portion reinforcing ribs being located between the two through holes, and a holding hole for receiving therein a switching element of said shearing tool;

a transparent bottom piece provided with a recessed holding slot; and a connection piece located between said top piece and said bottom piece such that said top piece and said bottom piece can be folded and unfolded where the reinforcing ribs of the holding portion permit the shearing tool to be pivotally actuated within the device.

2. The device as defined in claim 1, wherein said top piece and said bottom piece are provided respectively with a plurality of means for retaining said top piece and said bottom piece when said top piece and said bottom piece are folded together.

3. The device as defined in claim 1, wherein said connection piece is provided with a folding edge of a memory type to facilitate the folding and the unfolding of said top piece and said bottom piece.

4. The device according to claim 1 further comprising a plurality of cooperating retaining bodies formed in the top piece and the bottom piece to hold the top and bottom pieces together.

* * * * *